US010126712B2

(12) United States Patent
Strahm et al.

(10) Patent No.: US 10,126,712 B2
(45) Date of Patent: Nov. 13, 2018

(54) BALANCE SPRING STUD-HOLDER WITH SECURE ASSEMBLY

(71) Applicant: ETA SA Manufacture Horlogere Suisse, Grenchen (CH)

(72) Inventors: Florent Strahm, Sonceboz-Sombeval (CH); Ivan Villar, Brugg (CH); Laurent Kaelin, Sonvilier (CH); Thierry Conus, Lengnau (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 77 days.

(21) Appl. No.: 15/355,886

(22) Filed: Nov. 18, 2016

(65) Prior Publication Data

US 2017/0168455 A1 Jun. 15, 2017

(30) Foreign Application Priority Data

Dec. 11, 2015 (EP) ..... 15199637

(51) Int. Cl.
*G04B 17/32* (2006.01)
*G04B 15/14* (2006.01)
*G04B 17/06* (2006.01)

(52) U.S. Cl.
CPC ..... *G04B 17/325* (2013.01); *G04B 15/14* (2013.01); *G04B 17/063* (2013.01)

(58) Field of Classification Search
CPC .... G04B 17/32; G04B 17/325; G04B 17/063; G04B 18/06; G04B 15/14; G04B 17/34; G04B 17/345
USPC ..... 368/178
See application file for complete search history.

(56) References Cited

U.S. PATENT DOCUMENTS 9,098,067 B2 * 8/2015 Koda ..... G04B 15/14
2014/0341001 A1 * 11/2014 Cordier ..... G04B 15/14 368/131
2015/0177689 A1 6/2015 Capt

FOREIGN PATENT DOCUMENTS

CH 705 440 A2 3/2013
EP 2 887 154 A1 6/2015

OTHER PUBLICATIONS

European Search Report dated Apr. 20, 2016 in European Application 15199637.8 filed on Dec. 11, 2015 (with English Translation of Categories of Cited Documents).

* cited by examiner

*Primary Examiner* — Amy Cohen Johnson
*Assistant Examiner* — Jason Collins
(74) *Attorney, Agent, or Firm* — Oblon, McClelland, Maier & Neustadt, L.L.P.

(57) ABSTRACT

The present invention concerns an assembly for holding or supporting a timepiece balance spring, comprising a balance spring stud and a balance cock on which is fixed a balance spring stud-holder, wherein said stud-holder comprises a holding means provided with a housing for housing the balance spring stud therein and a gripping means, at least said gripping means being movable with respect to the holding means in order to lock the balance spring stud inside its housing.

10 Claims, 4 Drawing Sheets

BALANCE SPRING STUD-HOLDER WITH SECURE ASSEMBLY

This application claims priority from European Patent application 15199637.8 of Dec. 11, 2015, the entire disclosure of which is hereby incorporated herein by reference.

The present invention concerns an assembly for holding or supporting a timepiece balance spring including a balance spring stud and a stud-holder.

PRIOR ART

In a mechanical watch, it is usual to use a regulating member comprising a sprung-balance device. Conventionally, the inner end of the balance spring is attached to a collet provided on the balance staff. In order to attach and position the inner end of the balance spring, it is known to use a stud-holder housing a balance spring stud, in association with a clamping screw to clamp the stud against the portion of the balance spring engaged in the stud-holder.

In such an assembly, the stud-holder is conventionally attached to a balance-cock also used for attaching one of the ends of the balance staff. The balance-cock is devised to incorporate a setting equipped with a shock-absorber device for the balance staff. A known stud-holder uses two rings. These two rings are mounted to be movable in rotation at the setting. Each ring comprises an extension in the shape of a tuning fork or a Y, the Y-shaped fork thus forming a housing.

A first ring is then used so that the balance spring stud is housed therein and secured via a screw, whereas the second ring is used so that an adjustment element is housed therein. This adjustment element makes it possible to adjust the limitation of the balance spring to adjust the rate and therefore the frequency of the balance spring.

However, such a device has the drawback of being complicated to use when a maintenance or repair operation is performed by the after sales service. Indeed, the presence of a multitude of parts and the fact that it is necessary to screw in the balance spring stud in order to hold it in place, makes this operation difficult and requires adjustment steps afterwards.

SUMMARY OF THE INVENTION

It is an object of the invention to overcome the drawbacks of the prior art by proposing to provide an assembly for holding or supporting a timepiece balance spring which allows for simplified assembly or disassembly and a good hold of the balance spring stud.

To this end, the present invention concerns an assembly for holding or supporting a timepiece balance spring, comprising a balance spring stud and a balance cock on which is fixed a balance spring stud-holder, characterized in that said stud-holder comprises a holding means provided with a housing for housing the balance spring stud therein and a gripping means, at least said gripping means being movable with respect to the holding means in order to lock the balance spring stud inside its housing.

The advantage of the invention is that it allows the "silicon balance spring/balance cock" assembly to be easily disassembled during after-sales service. By unlocking the balance spring stud by means of the gripping means, one can simply remove the "balance/balance spring/balance spring stud" part from the "balance cock/balance spring stud-holder/shock absorber" part, without the risk of breaking the balance spring.

In a first advantageous embodiment, the holding means and the gripping means take the form of an annular piece arranged to be rotatably mounted on a protuberance.

In a second advantageous embodiment, the holding means take the form of a holding ring comprising balance spring stud receiving means 51 comprising two extended portions projecting from said holding ring and being spaced apart from each other to form a housing inside which balance spring stud can be housed.

In a third advantageous embodiment, the holding means take the form of a holding ring comprising balance spring stud receiving means comprising an extended portion' projecting from said holding ring, said extended portion being provided with an opening forming a housing' inside which balance spring stud can be housed.

In a fourth advantageous embodiment, the gripping means take the form of a ring also comprising a resilient arm extending from gripping ring in a substantially similar direction to that of the curvature of said gripping ring in order to form a space between gripping ring and said arm, said space allowing the balance spring stud to be inserted therein and pressed into its housing by said resilient arm.

In a fifth advantageous embodiment, the holding means take the form of a holding ring comprising a resilient arm extending from said ring and forming therewith a housing for accommodating the balance spring stud.

In a sixth advantageous embodiment, the gripping means take the form of a gripping ring comprising a frame on which a stud is arranged, the frame and the stud being arranged such that the rotation of the gripping ring with respect to the holding ring results in the appearance of a stress exerted by said stud on said resilient arm in order to lock the balance spring stud assembly.

In a seventh advantageous embodiment, the gripping means take the form of a gripping ring comprising a frame on which a structure provided with a groove is arranged, the groove being arranged such that the resilient arm can be inserted therein so that the rotation of said locking ring with respect to the holding ring causes a deformation of said arm in order to lock the balance spring stud assembly.

In another advantageous embodiment, the frame comprises at least two radially extending arms, connected to each other by a crosspiece, the at least two arms being spaced apart so as to allow the balance spring stud to be set in place and locked without the risk of any contact with said arms.

In another advantageous embodiment, the gripping ring and the holding ring each comprise a radially extending positioning extension piece allowing for gripping thereof by a tool of the tweezer type in order to rotate the gripping ring and the holding ring.

In another advantageous embodiment, the positioning extension piece of the gripping ring and of the arms of the frame form only a single piece.

In another advantageous embodiment, the positioning extension pieces of the gripping ring and of the holding ring are arranged to face each other when the balance spring stud is locked to allow them to be simultaneously gripped to perform an angular adjustment of the position of the balance spring stud with respect to the balance cock.

BRIEF DESCRIPTION OF THE DRAWINGS

The objects, advantages and features of the invention will appear more clearly in the following detailed description of at least one embodiment of the invention, given solely by way of non-limiting example and illustrated by the annexed drawings, in which.

DETAILED DESCRIPTION

The present invention proceeds from the general idea of providing an assembly for holding or supporting a timepiece balance spring permitting simpler assembly/disassembly of the balance spring stud.

Figure 1:
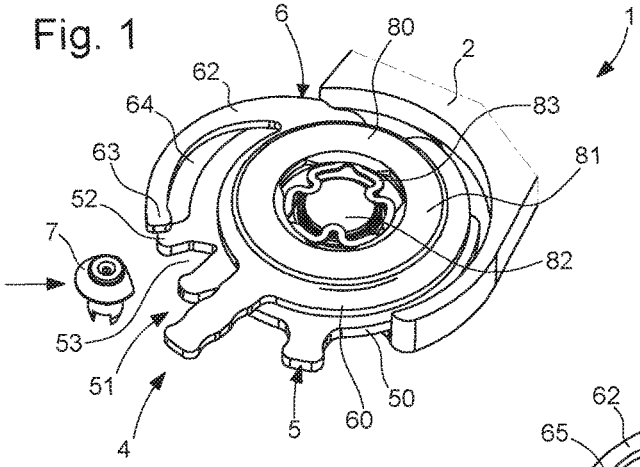
FIGS. 1 to 5 represent a first embodiment of the holding assembly according to the invention.

FIG. 1 shows the holding or support assembly 1 according to the present invention. This assembly 1 is mounted on a balance cock 2 and comprises a balance spring stud-holder 4 used for holding a balance spring stud 7.

Balance spring stud-holder 4 according to the invention comprises holding means 5 and gripping means 6. Holding means 5 are used to support balance spring stud 7 whereas gripping means 6 are used to lock the position of balance spring stud 7 on holding means 5.

In a first embodiment seen in FIGS. 1 to 5, holding means 5 take the form of a holding ring 50. This holding ring 50 is closed or open and is dimensioned to be arranged on a protuberance 8. Balance cock 2 can be made to comprise a pivoting device 80, this pivoting device 80 may take the form of a setting 81 provided with a jewel hole and endstone 82 and with a spring 83, or the form of a stud 84 provided with a hole 85 in which the balance staff engages. Protuberance 8 could be this pivoting device 80. The protuberance is circular.

The holding ring is force fitted on pivoting device 8, i.e. on setting 80 or stud 83. A groove extending over the periphery of stud 83 or of setting 80 could be provided to prevent vertical displacement of holding ring 50. Holding ring 50 further comprises balance spring stud receiving means 51. These receiving means 51 comprised two projecting extended portions 52, extended in parallel outwards from holding ring 50. These two extended portions 52 are spaced apart from each other to form a housing space 53 inside which balance spring stud 7 can be housed. It is thus understood that these two extended portions project from holding ring 50 but also from the balance cock.

In this first embodiment, gripping means 6 take the form of a gripping ring 60. Gripping ring 60 is closed or open and is dimensioned to be arranged on pivoting device 8, like the holding ring. Gripping ring 60 is thus forced fitted onto pivoting device 8. A groove extending over the periphery of stud 83 or of setting 80, parallel to that of holding ring 50, could be provided to prevent vertical displacement of the gripping ring. The gripping ring is thus located above the holding ring. Gripping ring 60 further comprises a resilient arm 62. This arm 62 extends from said gripping ring 60 and has a free end 63. Arm 62 extends from gripping ring 60 in a substantially similar direction to that of the curvature of said gripping ring in order to form a space 64 between gripping ring 60 and said arm 62.

To operate this device, balance spring stud 7 is placed inside housing 53 of holding ring 50. Gripping ring 60 is then rotated such that the end 63 of resilient arm 62 moves closer to the balance spring stud. The free end 63 of resilient arm 62 is skillfully arranged to comprise a lug 65 in order to be partially in contact with the balance spring stud. Consequently, the operator responsible for assembly is obliged to apply a slight force when rotating gripping ring 60. Under the effect of this stress, resilient arm 62 is deformed and moves aside. This leaves a larger space for insertion of balance spring stud 7. When balance spring stud 7 passes the free end 63 of resilient arm 62 provided with lug 64, said resilient arm 62 tends to return to its rest or initial position. In this case, it tends to exert a force on the balance spring stud. Since the stud is inside housing 53 of holding ring 50, this force exerted by the resilient arm makes it possible to lock the position of the balance spring stud. Gripping ring 60 and holding ring 50 must be dimensioned such that the friction between them and pivoting means 8 can permit a rotation of the rings while preventing an untimely rotation of the rings. Thus, by unlocking the balance spring stud by means of the gripping means, one can simply remove the "balance/balance spring/balance spring stud" part from the "balance cock/balance spring stud-holder/shock absorber" part, without the risk of breaking the balance spring.

Figure 4:
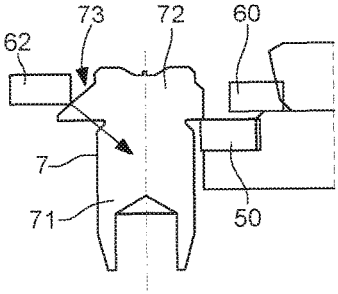
Figure 5:
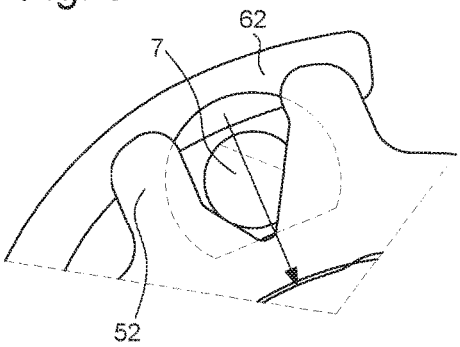
Figure 6:
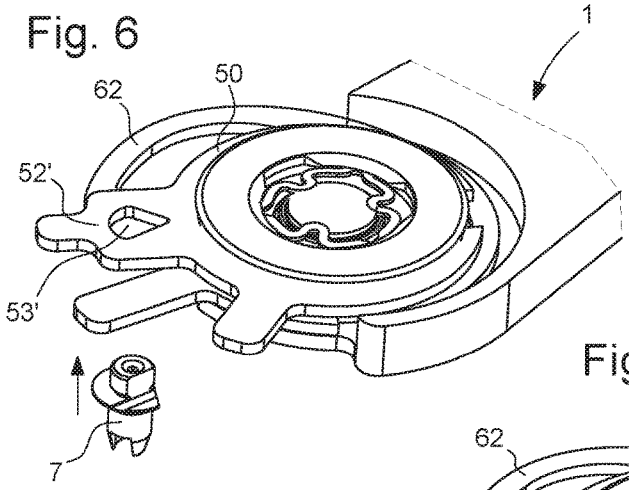
FIGS. 6 to 10 represent a variant of the first embodiment of the holding assembly according to the invention.
Figure 7:
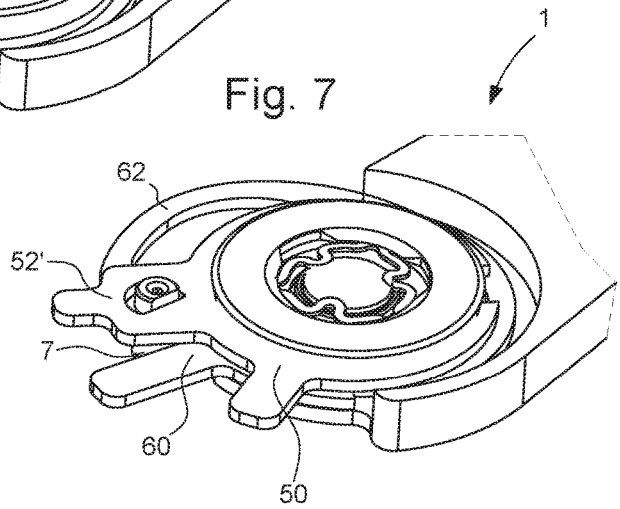
Figure 8:
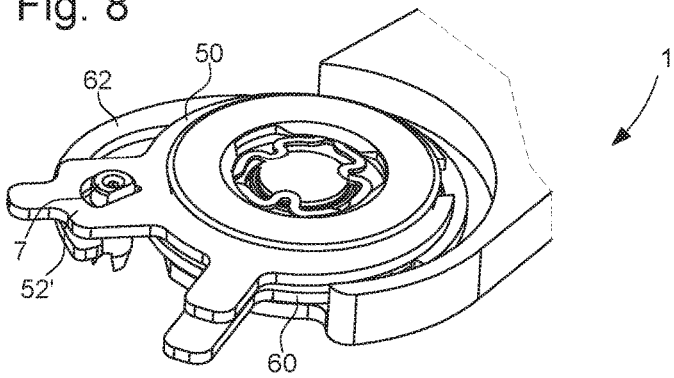
Figure 10:
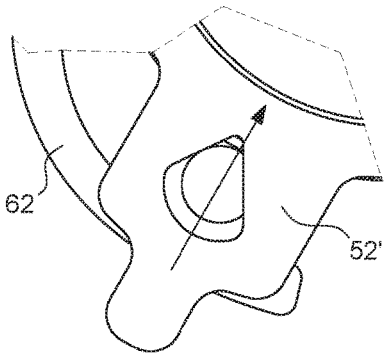
Figure 9:
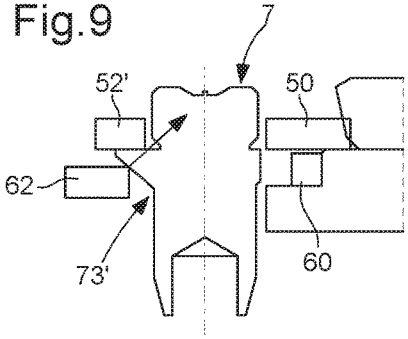

In an advantageous variant seen in FIGS. 4 and 5, balance spring stud 7 has a body 71 arranged to allow attachment of the balance spring and a head 72, said head having a conical profile 73 whose diameter is greater than that of body 71. The head of balance spring stud 72 is capable of resting on the two projecting extended portions 52 The resilient arm that comes into contact with the balance spring stud on this conical profile then exerts a force perpendicular to the slope of the cone so as to press the balance spring stud along the z axis against the two projecting extended portions 52 and into its housing along the x, y axes. Housing 53 and/or balance spring stud 7 may comprise flat portions to achieve angular locking.

Figure 2:
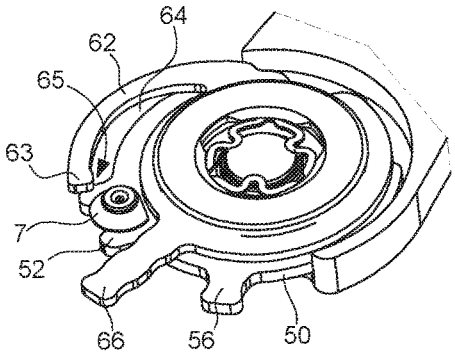
Figure 3:
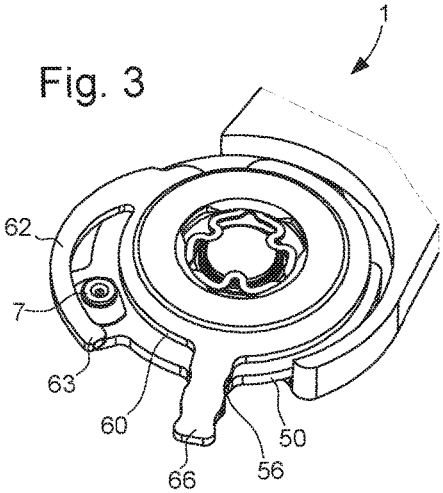

In an advantageous variant seen in FIG. 2, holding ring 50 and gripping ring 60 each have a positioning extension piece 56, 66. Gripping ring 60 and holding ring 50 thus each comprise a radially extending extension piece, this extension piece allowing for gripping by a tweezer type tool. Cleverly, it will be provided that these extension pieces 56, 66 are arranged such that they face each other when balance spring stud 7 is locked, as seen in FIG. 3. This arrangement makes it possible to rotate gripping means 60 and holding means 50 at the same time.

In a variant of this first embodiment seen in FIGS. 6 to 10, holding ring 50 is made such that balance spring stud receiving means 51 take the form of a single extension piece 52' pierced with an opening forming a housing 53' for balance spring stud 7. In this case, the gripping ring is arranged underneath the holding ring and the head 72 of balance spring stud 7 has an inverted cone profile 73'. In this variant configuration, the assembly is similar, so that resilient arm 62 comes into contact with the cone 73' of balance spring stud 7 and generates a force perpendicular to the slope of cone 73'. This force presses balance spring stud 7 into its housing 53' along the Z axis and into its housing on the X, Y axis. The housing and/or the balance spring stud may comprise flat portions to achieve angular locking.

In a second embodiment seen in FIGS. 11 to 15, holding means 5 take the form of a holding ring 500. Holding ring 500 is closed or open and is dimensioned to be arranged on pivoting device 8, which is of substantially circular shape. The holding ring is force fitted on pivoting device 8, i.e. on setting 80 or stud 83. A groove extending over the periphery of stud 83 or of setting 80 could be provided to prevent vertical displacement of holding ring 500. Holding ring 500 further comprises balance spring stud receiving means 510. These receiving means 510 comprise a resilient arm 512 extending from said ring and forming therewith a housing 514 for accommodating the balance spring stud.

In this second embodiment, gripping means 6 take the form of a gripping ring 600. Gripping ring 600 is closed or open and is dimensioned to be arranged on pivoting device 8, like the holding ring. Gripping ring 600 is thus forced fitted onto pivoting device 8. A groove extending over the periphery of stud 83 or of setting 80, parallel to that of holding ring 500, could be provided to prevent vertical displacement of gripping ring 600. Gripping ring 600 is thus located above holding ring 500.

Gripping ring 600 comprises a stud 602 mounted on a frame 604. In fact, the operating principle of this second embodiment uses this stud 602 to exert a stress on resilient arm 512 in order to lock balance spring stud 7. Gripping ring 600 is then rotated such that stud 602 enters into contact with resilient arm 512. As the rotation of the gripping ring continues, the stress exerted on resilient arm 51 causes the deformation of the arm and thus locks the balance spring stud. Frame 604 thus allows stud 602 to be moved off centre. In a conventional manner, frame 604 could be an arm 604 whose free end 605' is provided with said stud 602. The latter could be in one piece with frame 604, or free end 605' could be provided with a hole in which stud 602 could be placed and secured.

In an advantageous version, the frame comprises at least two arms 605*a*, 605*b* extending radially from ring 600, these arms 605 being connected to each other by a bar or crosspiece 606. Bar 606 is provided with a protuberance on which the stud is arranged. This configuration allows for better rigidity than a frame comprising only one arm.

Figure 11:
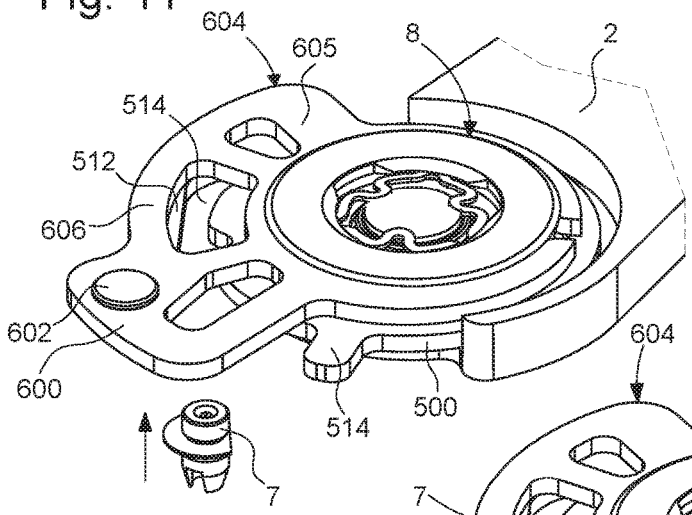
FIGS. 11 to 15 represent a second embodiment of the holding assembly according to the invention.
Figure 12:
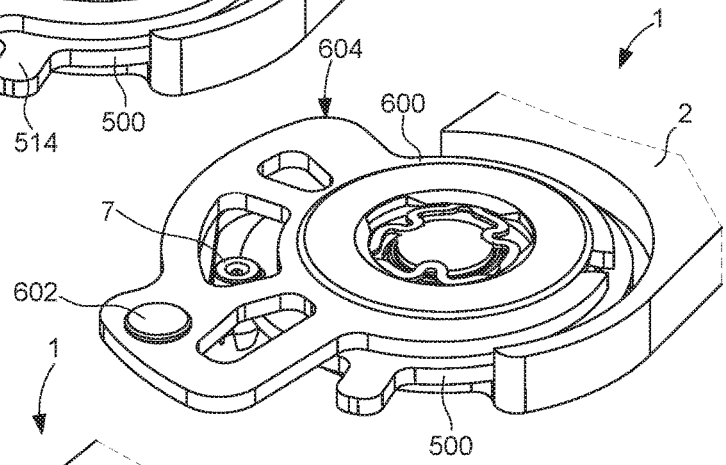
Figure 13:
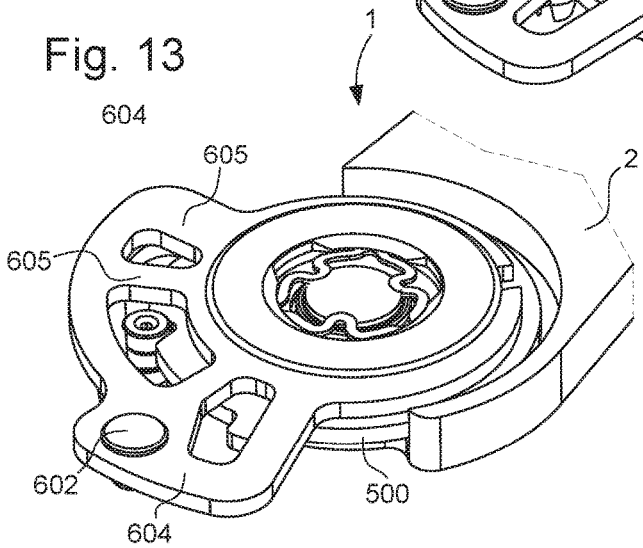

In this frame configuration seen in FIG. 11, it is provided that the spacing between at least two arms 605 is sufficient to allow balance spring stud 7 to be housed therein without entering into contact with said arms during rotation of the gripping ring. Advantageously, one of arms 605 of frame 604 will be arranged such that, when balance spring stud 7 is locked, said arm is facing a positioning extension piece 516 of holding ring 500. This configuration thus provides the possibility of the operator grasping arm 605 and extension piece 516 by means of tweezers in order to change the angular position of the two rings 500 and 600. This therefore offers the possibility of angular adjustment without changing the locking of balance spring stud 7.

In a preferred configuration, frame 604 comprises four arms 605. The spacing between the second arm 605 and the third arm 605 is chosen for accommodating balance spring stud 7. The fourth arm 605 is arranged to be able to be used in cooperation with an extension piece 516 to change the angular position of the two rings 500, 600.

Figure 14:
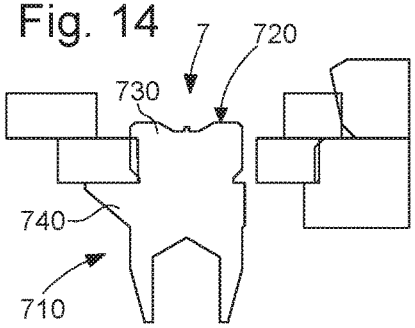
Figure 15:
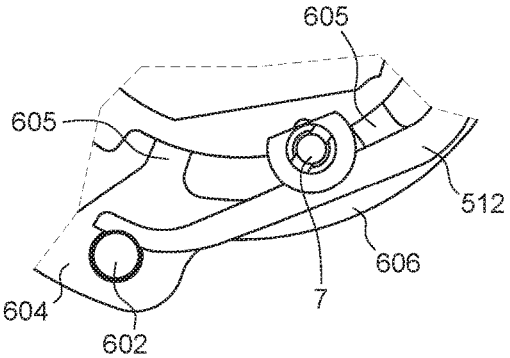

It could be envisaged that balance spring stud 7 has a body 710 arranged to allow attachment of the balance spring and a head 720, said head 720 having a cylindrical profile 730. Body 710 further comprises a projecting portion 740 forming a platform for resilient arm 512, as seen in FIG. 14.

Figure 16:
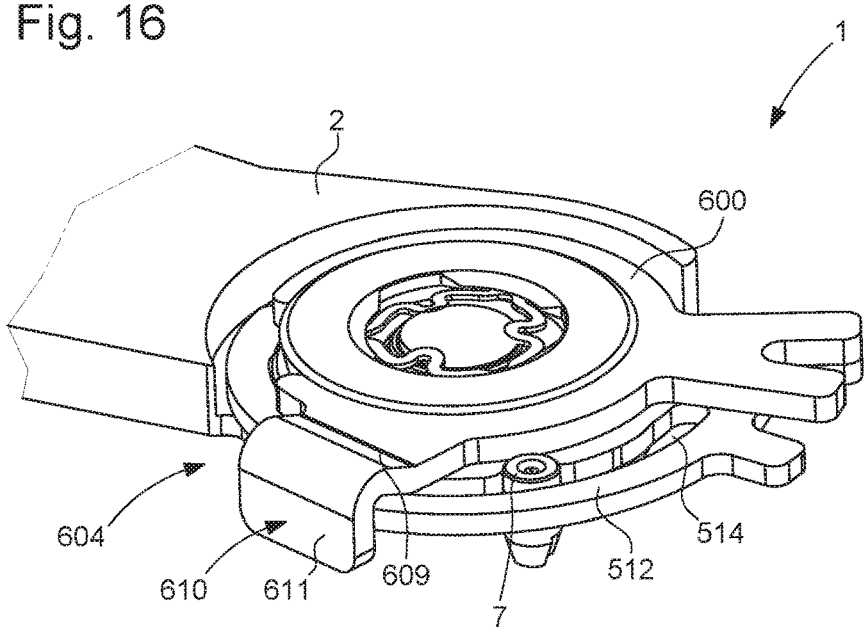
FIGS. 16 and 17 represent a variant of the second embodiment of the holding assembly according to the invention.
Figure 17:
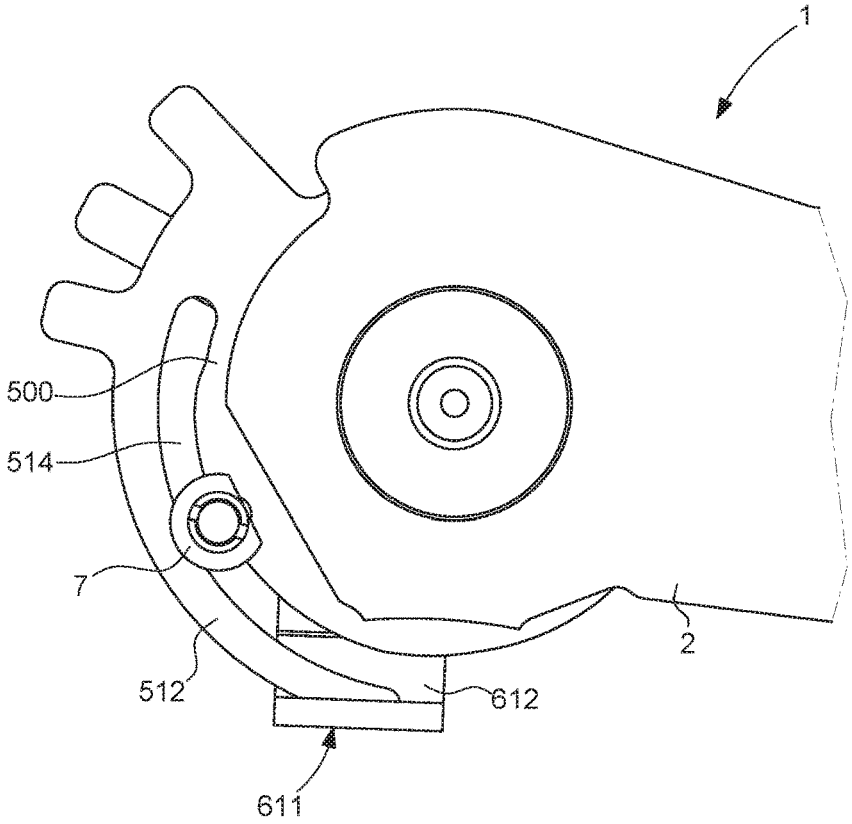

In a variant of the second embodiment seen in FIGS. 16 and 17, frame 604 comprises one arm 609 whose free end 609' ends in a structure 610. This structure 610 takes the form of a part 611 having a groove 612 similar to a guide groove inside which resilient arm 512 of holding ring 500 is housed. The tension of resilient arm 512 allows the latter to be in permanent contact with one of the walls of groove 612 of structure 610. Consequently, during the rotation of gripping ring 600 carrying frame 604, resilient arm 512, guided by the groove of structure 610, is thus deformed. This deformation allows resilient arm 512 to grip balance spring stud 7 and thus to lock the position of the latter.

It will be clear that various alterations and/or improvements and/or combinations evident to those skilled in the art may be made to the various embodiments of the invention set out above without departing from the scope of the invention defined by the annexed claims.

For example, it could be envisaged that the balance spring is of smaller diameter than the dimension of the balance spring stud-holder, such that it is protected by said stud-holder. Indeed, it has become common to use silicon balance springs, as this material has advantageous amagnetic properties. However, silicon is a brittle material which breaks in the event of excessive shocks. By configuring the balance spring stud-holder and the balance spring so that the balance spring is of smaller dimensions than the balance spring stud-holder, the stud-holder is used as protection for the silicon balance spring against any shocks that may occur during timing of the watch or after sales servicing.

What is claimed is:

1. An assembly for holding or supporting a timepiece balance spring, comprising a balance spring stud and a balance cock on which is fixed a balance spring stud-holder, comprising:

a holding means provided with a housing for housing the balance spring stud therein and a gripping means, at least said gripping means being movable with respect to the holding means in order to lock the balance spring stud inside the housing, wherein the holding means and the gripping means comprise an annular piece arranged to be rotatably mounted on a protuberance, and wherein the holding means comprise a holding ring comprising a resilient arm extending from said ring and forming therewith a housing for accommodating the balance spring stud.

2. The assembly according to claim 1, wherein the gripping means comprise a gripping ring comprising a frame on which a stud is arranged, the frame and the stud being arranged such that the rotation of the gripping ring with respect to the holding ring results in the appearance of a stress exerted by said stud on said resilient arm in order to lock the balance spring stud assembly.

3. The assembly according to claim 2, wherein the frame comprises at least two radially extending arms, connected to each other by a crosspiece, the at least two arms being spaced apart so as to allow the balance spring stud to be set in place and locked without the risk of any contact with said arms.

4. The assembly according to claim 3, wherein the gripping ring and the holding ring each comprise a radially extending positioning extension piece configured to be gripped to rotate the gripping ring and the holding ring, and the positioning extension piece of the gripping ring and of the arms of the frame form only a single piece.

5. The assembly according to claim 1, wherein the gripping means comprise a gripping ring comprising a frame on which is arranged a structure provided with a groove, the groove being arranged such that the resilient arm can be inserted therein so that the rotation of said locking ring with respect to the holding ring causes a deformation of said arm in order to lock the balance spring stud assembly.

6. The assembly according to claim 1, wherein the gripping ring and the holding ring each comprise a radially extending positioning extension piece configured to be gripped to rotate the gripping ring and the holding ring.

7. The assembly according to claim 6, wherein the positioning extension pieces of the gripping ring and of the holding ring are arranged to face each other when the balance spring stud is locked to allow simultaneously gripping thereof to perform an angular adjustment of the position of the balance spring stud with respect to the balance cock.

8. A timepiece movement comprising a main plate on which is mounted an energy source supplying energy to the transmission gear trains, said gear trains cooperating with an escapement system via an escape wheel whose rotation is regulated by a pallet lever of the escapement system whose pulses are provided by a sprung balance, said balance spring being mounted on a holding assembly according to claim 1.

9. The timepiece movement according to claim 8, wherein the gripping means comprise a gripping ring comprising a frame on which a stud is arranged, the frame and the stud being arranged such that the rotation of the gripping ring with respect to the holding ring results in the appearance of a stress exerted by said stud on said resilient arm in order to lock the balance spring stud assembly.

10. The timepiece movement according to claim 8, wherein the gripping means comprise a gripping ring comprising a frame on which is arranged a structure provided with a groove, the groove being arranged such that the resilient arm can be inserted therein so that the rotation of said locking ring with respect to the holding ring causes a deformation of said arm in order to lock the balance spring stud assembly.

* * * * *